United States Patent [19]

Seidoh

[11] Patent Number: 4,929,195

[45] Date of Patent: May 29, 1990

[54] SHIELD CONNECTOR

[75] Inventor: Masami Seidoh, Tokyo, Japan

[73] Assignee: Jupiter Dentsu Co., Ltd., Tokyo, Japan

[21] Appl. No.: 257,817

[22] Filed: Oct. 14, 1988

Related U.S. Application Data

[63] Continuation-in-part of Ser. No. 15,118, Feb. 17, 1987, abandoned.

[30] Foreign Application Priority Data

Feb. 21, 1986 [JP] Japan ..... 61-22938

[51] Int. Cl.[5] ..... H01R 9/03

[52] U.S. Cl. ..... 439/610; 439/88; 439/465; 439/906

[58] Field of Search ..... 439/607, 609, 608, 610, 439/88, 274, 275, 279, 465, 497, 906

[56] References Cited

U.S. PATENT DOCUMENTS

| | | | |
|---|---|---|---|
| 2,209,814 | 7/1940 | Finger | 439/455 X |
| 4,449,778 | 5/1984 | Lane | 439/357 X |
| 4,557,545 | 12/1985 | Ohtsuki et al. | 439/607 X |
| 4,597,624 | 7/1986 | Lax et al. | 439/610 |
| 4,641,902 | 2/1987 | Fusselman | 439/607 X |
| 4,653,825 | 3/1987 | Olsson | 439/607 X |

OTHER PUBLICATIONS

AMP Bulletin (15 Symposium Proceedings), Landis, p. 357, 11-1982.

*Primary Examiner*—Neil Abrams
*Assistant Examiner*—Khiem Nguyen
*Attorney, Agent, or Firm*—Zarley, McKee, Thomte, Voorhees & Sease

[57] ABSTRACT

The shield connector is constructed with an electrically conductive stopper formed by an integrally insulated coating and a shield coating at the end portion of a shield wire. On the outer surface of the stopper an annular groove is bored. An inserting hold bored on the bottom of a shield case is assembled by coupling two shield case pieces and includes a bottom wall with a hole therein which engages the groove.

1 Claim, 4 Drawing Sheets

SHIELD CONNECTOR

This application is a continuation-in-part of co-pending application Ser. No. 015,118, filed Feb. 17, 1987 now abandoned.

BACKGROUND OF THE INVENTION

The present invention relates to a shield connector for connecting shield wires with each other, and particularly relates to a connector for connecting effectively multi-core shield wires with each other which have been widely used for weak electric appliances.

FIGS. 5 and 6 show the first example of a male terminal of one of a conventional shield connector. As shown in FIG. 5, a holding member 52 composed of an insulating material has a plurality of electrical contacting pieces 51 extending outwardly. A metallic guiding tube 53 is used in coupling the contacting pieces with a female terminal. An attaching flange 54 is integrally installed to the guide tube 53.

A plurality of cable cores 56 of a multi-core cable 55 are soldered to the above described contacting pieces 51. An end portion of an insulting coating 57 is cut out a predetermined length, and an end portion 58*a* of an exposed shield coating 58 of metal netting is twisted to form a thread shape.

The reference number 59 designates a metal shield cover of rectangular shape and being divided at the central portion into two similarly shaped upper and lower pieces 59*a* and 59*b*. The end of the upper pieces 59*a* is provided with an arcuate grasping piece 60*a* into which the upper half of the multi-core shield cable 55 is inserted. Similarly, a grasping piece 60*b* of a semi-circular shape is provided on lower piece 59*b* for receiving the lower half of the multi-core shield cable 55.

As shown in FIG. 6, the lower pieces 59*a* and 59*b* are soldered or spot-welded to the flange 54. Both the grasping pieces 60*a* and 60*b* are caulked to the multi-core shielded cable 55 so that when tension is applied to the multi-core shielded cable 55, the cable cores 56 may not be cut by an accidental tension. In addition, when the shield cover 59 is assembled, by drawing out the twisted end portion 58*a* of the shield coating 58 and soldering is to the outer surface of the shield cover 59, a conducting state is kept between them.

A female terminal of the shield connector is different merely in the shapes of the contacting piece and the holding member from those of the above mentioned male terminal, but is otherwise similar to the male terminal, so that no description or drawing is given therefor.

In FIGS. 7 and 8 there is shown the second example of a male terminal of a conventional shield connector. The reference numbers 71, 72, 73 and 74 shown in FIG. 7 designate a contacting piece, a holding member, a guide tube and a flange, respectively.

The reference numbers 75, 76, 77 and 78 indicate a multicore shield cable, a core wire, an insulating coating and a shield coating, respectively. At the end portion of the shielded coating 77 there is provided a fall-off preventing annulus 79 formed with a thick linear material so that it may wind and squeeze the thread formed end portion 78*a* of the shield coating 78. A shield cover 80 is a rectangulr tubular shape and has a bottom part. A shield wire 75 is inserted into a penetrating hole (not shown) bored on the bottom part.

As shown in FIG. 8, the open end portion of the shield cover 80 is secured to the flange 74. The fall-off preventing annulus 79 contacts the bottom part of the shield cover 80, so that the core wire 76 is protected and so that it may not be broken.

The end portion 78*a* of the shield coating 78 is drawn out along the multi-core shield cable 75 and is soldered to the shield cover 80.

The first example of the conventional shield connector shown in FIG. 5 and 6 can not have strong grasping forced between thick shield cable 55 and the grasping pieces 60*a* and 60*b* because of the upper limit to the thickness of the shield cover 59. In the second example of the conventional shield connector there is apprehension of intruding noises from a gap between the penetrating hole of the shield cover 80 and the shield wire 75 which penetrates the hole, so that it is undesirable to widen the gap. Accordingly, it has been hard to draw out the end portion 78*a* of the shield coating 78.

Furthermore, in both examples of the conventional shield connectors, it is necessary to twist the end terminals 58*a* and 78*a* of the respective shield casings 58 and 78 to form a thread. The twisted end portions 58*a* and 78*a* are secured to the respective shield covers 59 and 80 and/or to each of the flanges 54 and 74, such as by soldering.

SUMMARY OF THE INVENTION

In view of the aforementioned disadvantages of the conventional shield connector, the present invention aims to eliminate the disadvantages of the conventional shield connector. It is an object of the present invention to provide an improved shield connector which comprises a stopper made of electric conductive synthetic resin and formed integrally with the insulating coating and the shield coating at the end portion of the shield wire. Two shield case pieces are coupled with each other. An annular groove is provided on the outer surface of the stopper. A penetrating hole for preventing the shield wire from falling out is provided on the bottom part of the two shield case pieces. An attaching flange made of synthetic resin may be formed.

The penetrating hole bored on the bottom part of the shield case engages the stopper which is formed integrally with the isolating coating and the shield coating at the end terminal portion of the shield wire. An electric conductive condition exists between the shield case and the shield coating. Even if a large tensile force is applied to the shield wire, there is no necessity for tangling and twisting the core wires.

Further, when the attaching flange is formed the shield case pieces are coupled with each other to form a guide tube, so that troublesome works which have been indispensable in the conventional art, such as manufacturing the guide tube and the attaching flange separately and manually coupling the shield cover with them, can be eliminated.

DETAILED DESCRIPTION OF THE PREFERRED EMBODIMENT

Figure 1:
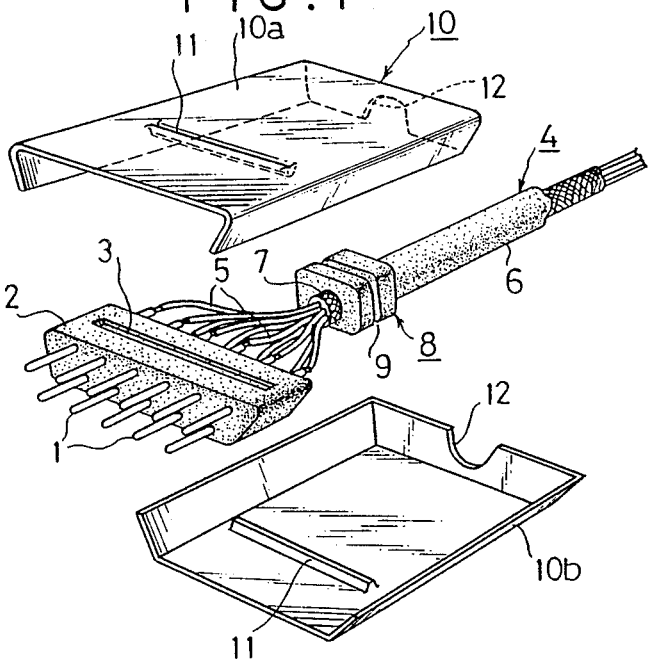
FIG. 1 is an exploded perspective view showing a male terminal of one embodiment of a shield connector according to the present invention.

One of the embodiments of the present invention is shown in FIGS. 1 to 4, in which the reference numbers 1 and 2 indicate a contacting piece and a holding member, respectively, similar to those of the contacting piece 51 and the holding member 52 of the conventional shield connector. On the upper and the lower sides of the holding member 2 an engaging groove 3 is provided.

A plurality of core wires 5 of a multi-core shield cable 4 are connected to the holding member 2. The end portion of an insulated coating 6 of the outer layer of cable 4 is cut out with a predetermined length on the cut out portion. A column shaped stopper 8 made of electric conductive synthetic resin covers coating 6 and an exposed shield coating 7. On the peripheral surface of the stopper 8 there is provided annular groove 9.

Figure 2:
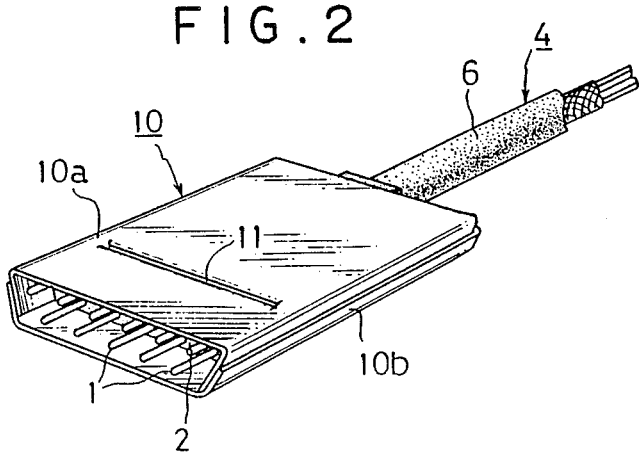
FIG. 2 is a perspective view of the male assembled terminal of the embodiment of the shield connector shown in FIG. 1.

The reference number 10 designates a shield case which corresponds to the one which is made by integrally coupling the above described guide tube 53 and the shield cover 59. As shown in FIG. 1, case 10 is divided into an upper piece 10*a* and a lower piece 10*b* and each of their divided edges is overlapped with each other to fit matingly. In both shield case pieces 10*a* and 10*b*, there is formed a projection 11 projecting inwardly and a semi-circular hole 12. As shown in FIGS. 1 and 2, upper piece 10*a* has inwardly flared sides and lower piece 10*b* has outwardly flared sides, such that the pices form a tubular shape with a trapezoidal cross section when assembled.

Figure 3:
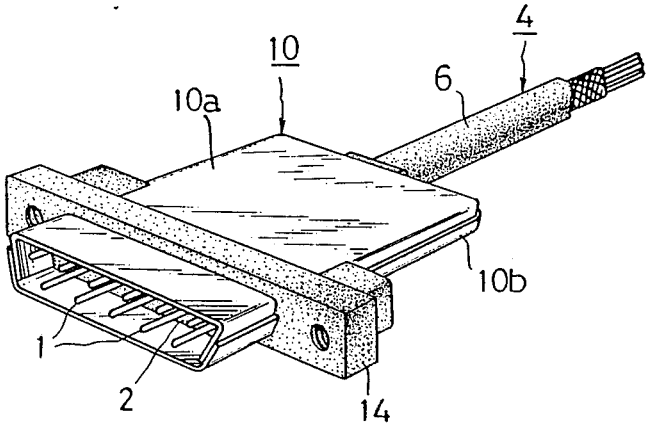
FIG. 3 is a perspective view of the male terminal shown in FIG. 1 having been assembled.
Figure 4:
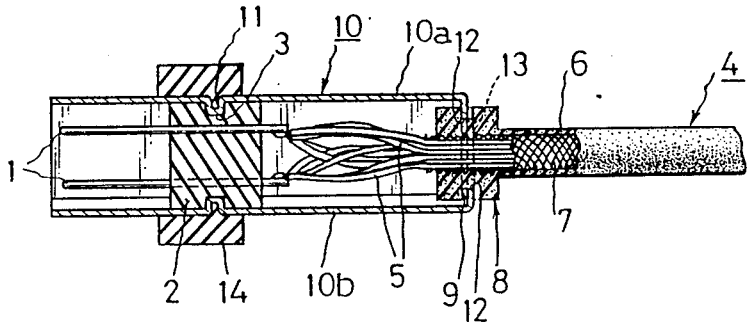
FIG. 4 is a longitudinally sectional side view cut along the central line.
Figure 5:
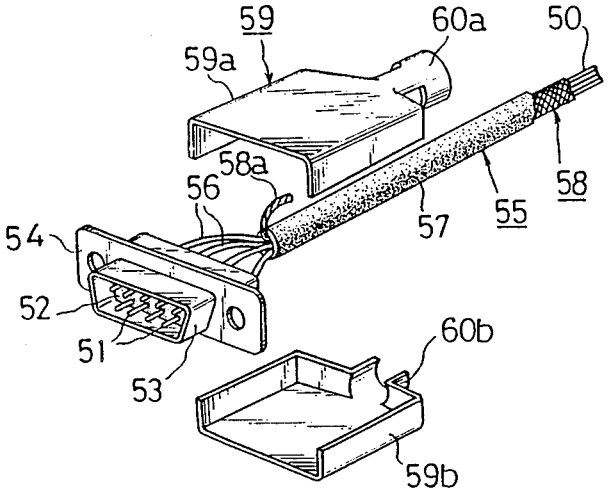
FIG. 5 PRIOR ART
FIG. 5 is an exploded perspective view of a male terminal of the conventional shield connector.
Figure 6:
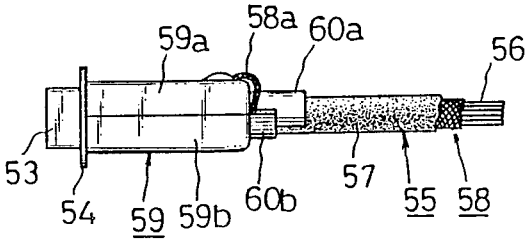
FIG. 6 PRIOR ART
FIG. 6 is a side view of the male terminal of the conventional shield connector shown in FIG. 5.
Figure 7:
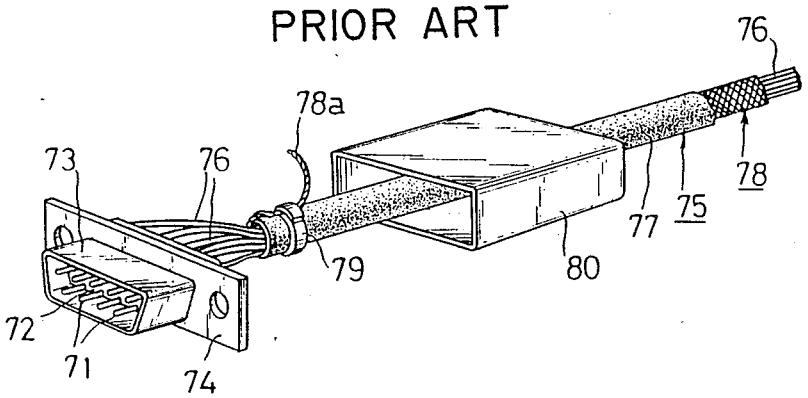
FIG. 7 PRIOR ART
FIG. 7 is an exploded perspective view of another male terminal of the conventional shield connector.
Figure 8:
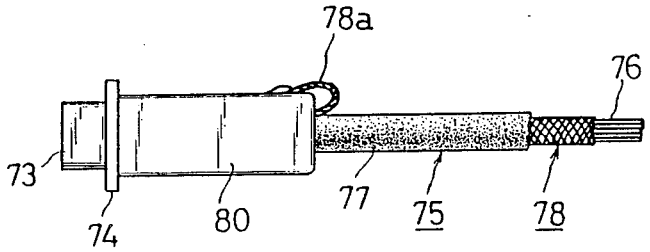
FIG. 8 PRIOR ART
FIG. 8 is a side view of the connector shown in FIG. 7.

As shown in FIG. 3, by setting both shield case pieces 10*a* and 10*b* on opposite sides of the holding member 2, the projection 11 and an engaging hole 13 formed by the upper and the lower semi-circular holes 12 engage the engaging groove 3 and the annular groove 9, respectively. An attaching flange 14 of synthetic resin is formed on the outer circumference of the projection 11 on both shield case pieces 10*a* and 10*b* such that these shield case pieces are coupled with each other to assemble the shield case 10. In this embodiment, the attaching flange 14 serves as a flange for engaging the male connector with a female connector.

Further, the female terminal of the shield connector is different merely in shapes of the contacting pieces and holding members from those of the male terminal, and structures of all the remaining parts are the same as those of the male terminal, so that description and illustration by the drawing are abbreviated.

The shield connector according to the present invention is adapted so that, as described above, the penetrating hole formed on the bottom surface of the shield case engages the stopper. The stopper is made of electrically conductive synthetic resin and is formed integrally with the insulating coating and the shield coating at the end of the shield wire, so that the shield case is automatically electrically conducted with the shield coating. Further, even if accidental large tensile force is applied to the shield wire no tensile force applies to the core wires, and there is also no necessity for soldering the core wires to the shield case.

In addition, in the case of an attaching flange being formed, the shield case pieces are coupled with each other simultaneously and a guide tube is formed. Accordingly, the conventional problem of separately manufacturing the guide tube and the attaching flange and then manually connecting the guide tube and flange with the shield cover is eliminated. Thus, shield connector according to the present invention can be made easily and inexpensively.

I claim:

1. A shield connector for multi-core shield cable, said cable having an insulated coating, a shield coating, and a plurality of core wires, said connector comprising:

an insulated holding member on the end of said cable and having a plurality of contacting elements implanted therein, said plurality of core wires being connected to the contacting elements;

a stopper on the end of said cable, the stopper having an annular groove in the surface thereof and being formed integrally with the insulated coating;

a shield case on the end of the cable and covering the holding member and contacting elements, said case being formed by joining two shield case pieces, said case having a hole therein, the edge of said hole engaging said annular groove of said stopper;

one of said shield case pieces being constructed to have outwardly flared sides, the other thereof being constructed to have inwardly narrowed sides, and when said pieces are engaged with each other, said case is formed to a tubular shape having a trapezoidal cross section;

an attaching flange surrounding the shield case pieces to hold them together and for securing the shield connector to a complimentary connector;

means for maintaining said case in position on said holding member, including an inwardly directed projection on at least one of said shield pieces and a recess in said holding member for receiving said projection; and the attaching flange being formed around the shield case pieces and into the inwardly directed projection on at least one of the pieces so as to maintain the attaching flange on the pieces.

* * * * *